US006981453B1

(12) United States Patent
Tinsley

(10) Patent No.: US 6,981,453 B1
(45) Date of Patent: Jan. 3, 2006

(54) PORTABLE MASSAGE TABLE

(76) Inventor: Ronald E. Tinsley, 2944 Adams St., Eugene, OR (US) 97405

( * ) Notice: Subject to any disclaimer, the term of this patent is extended or adjusted under 35 U.S.C. 154(b) by 0 days.

(21) Appl. No.: 10/864,174

(22) Filed: Jun. 8, 2004

Related U.S. Application Data

(60) Provisional application No. 60/477,715, filed on Jun. 10, 2003.

(51) Int. Cl.
*A47B 3/00* (2006.01)

(52) U.S. Cl. ..... 108/115; 108/36

(58) Field of Classification Search ..... 108/115, 108/34, 35, 36, 38, 132, 131, 130, 129
See application file for complete search history.

(56) References Cited

U.S. PATENT DOCUMENTS 3,359,576 A * 12/1967 Pile ..... 5/111
4,833,998 A * 5/1989 Everett et al. ..... 108/36
4,943,041 A * 7/1990 Romein ..... 5/620
5,335,676 A * 8/1994 O'Brien ..... 5/620
5,943,965 A 8/1999 Riach et al.
6,076,472 A * 6/2000 Lloyd ..... 108/36
6,192,809 B1 * 2/2001 Riach et al. ..... 108/115
6,259,669 B1 * 7/2001 Lee et al. ..... 369/116
6,705,234 B1 * 3/2004 Miller et al. ..... 108/36

* cited by examiner

*Primary Examiner*—Jose V. Chen
(74) *Attorney, Agent, or Firm*—Robert E. Howard

(57) ABSTRACT

A portable massage table including two abutting table top sections hingedly connected together. Each top section has a pair of legs pivotally attached thereto. A truss member is hingedly connected to one of the top sections. Table support cables extend from each of the outer corners of one of the top sections to the diagonally opposite corner of the other top section through the truss member. First leg support cables extend from a mid-portion of the inner end of the top sections to the lower half of each of the legs attached to that top section. Second leg support cables extend from each of the corners of the top sections to a mid-portion of the adjacent leg. Third leg support cables extend from the top of each leg to the top of the adjacent leg of the adjacent table top section.

2 Claims, 2 Drawing Sheets

PORTABLE MASSAGE TABLE

CROSS-REFERENCE TO RELATED APPLICATIONS

This application claims the benefit of U.S. Provisional Application No. 60/477,715, filed Jun. 10, 2003, the entire contents of which are hereby incorporated by reference.

BACKGROUND OF THE INVENTION

The present invention relates to a portable massage table.

Massage practitioners are frequently required to travel to a client's location. It is impossible to easily transport a conventional massage table, such as those used in the massage practitioner's office, to the client's location.

Numerous suggestions have been made for portable massage tables that are foldable, small, light weight and easy to fold into a compact package for transport and storage. Among the disadvantages of such foldable tables is that they are not as strong or structurally stable as a conventional massage table, and can collapse during use.

It is an object of the present invention to provide a portable massage table that which provides improved strength and stability required during use.

SUMMARY OF THE INVENTION

The portable massage table of the present invention includes a rectangular table top having a pair of table top sections. Each table top section has inner and outer ends and first and second sides. The inner ends of the table top sections abut and are hingedly connected to each other. Each of the table top sections has a perimeter frame rail extending downwardly from the inner and outer ends and from the first and second sides. Each of the table top sections has first and second inner corners at the juncture of the inner end with the first and second sides, respectively. Each of the table top sections has first and second outer corners at the juncture of the outer end with the first and second sides, respectively.

A centrally positioned V-shaped truss member includes first and second truss leg members, each truss leg member having inner and outer ends. The first and second truss leg members are joined at their outer ends to form a truss apex. The inner ends of the first and second truss leg members are hingedly secured to the inner end of one of the first and second table top sections. The truss member has an opening passing through the apex thereof and has slots passing through each of the first and second truss leg members adjacent the inner ends thereof.

First and second table legs are located adjacent the first and second outer corners of the first table top section, respectively. The first and second table legs are pivotally connected to the adjacent perimeter frame rail.

Third and fourth table legs are located adjacent the first and second outer corners of the second table top section, respectively. The first and second table legs are pivotally connected to the adjacent perimeter frame rail.

A first table support cable extends from the first corner of the first table top section, through an opening at the apex of the truss member, and to the diagonally opposite second corner of the second table top section.

A second table support cable extends from the second corner of the first table top section, through an opening at the apex of the truss member, and to the diagonally opposite first corner of the second table top section.

First table leg support cables extend from an attachment point located at a mid-portion of the inner end of the first table top section to each of the first and second table legs where they are attached to the lower half thereof. Similarly, second table leg support cables also extend from an attachment point located at a mid-portion of the inner end of the second table top section to each of the third and fourth table legs where they are attached to the lower half thereof.

Second table leg support cables extend from an attachment point located at the first and second corners of the first table top section to an attachment point located at a mid-portion of each of the first and second table legs, respectively. Similarly, first table leg support cables also extend from an attachment point located at the first and second corners of the second table top section to an attachment point located at a mid-portion of each of the third and fourth table legs, respectively.

Third table leg support cables extend between attachment points located at the tops of the first and third table legs through a slot in the first leg of the truss member. Similarly, third table leg support cables also extend between attachment points located at the tops of the second and fourth table legs through a slot in the second leg of the truss member.

Spring members extend from attachment points located at the first and second corners of the first and second table top sections to attachment points located at the top of each of the adjacently located first, second, third and fourth table legs.

DESCRIPTION OF PREFERRED EMBODIMENTS

Figure 1:
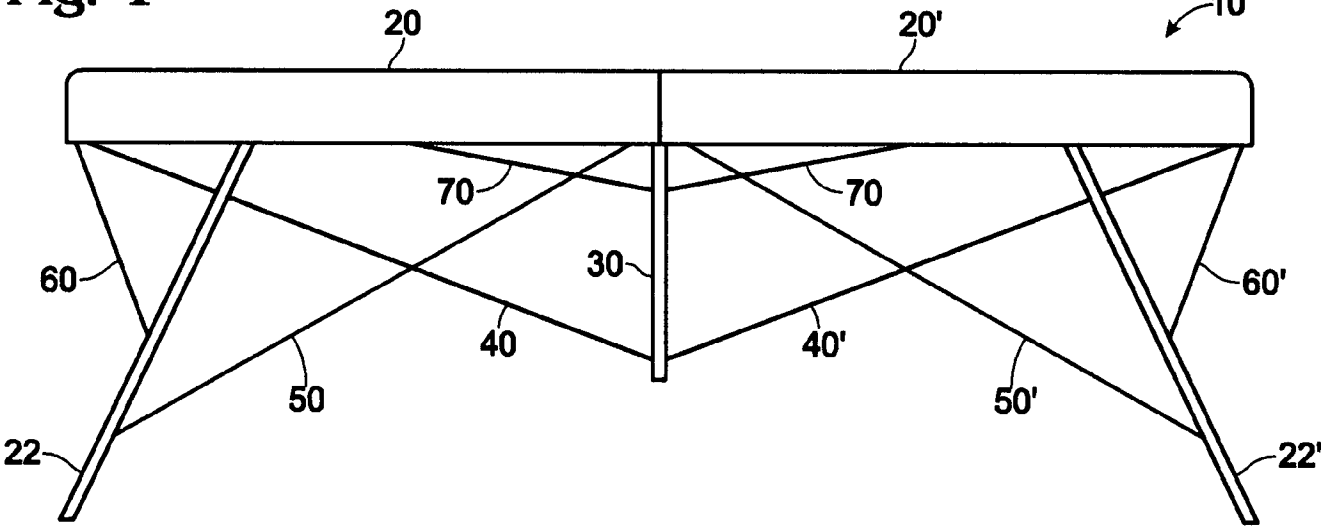
FIG. 1 is a side elevation view of the massage table of the present invention.
Figure 2:
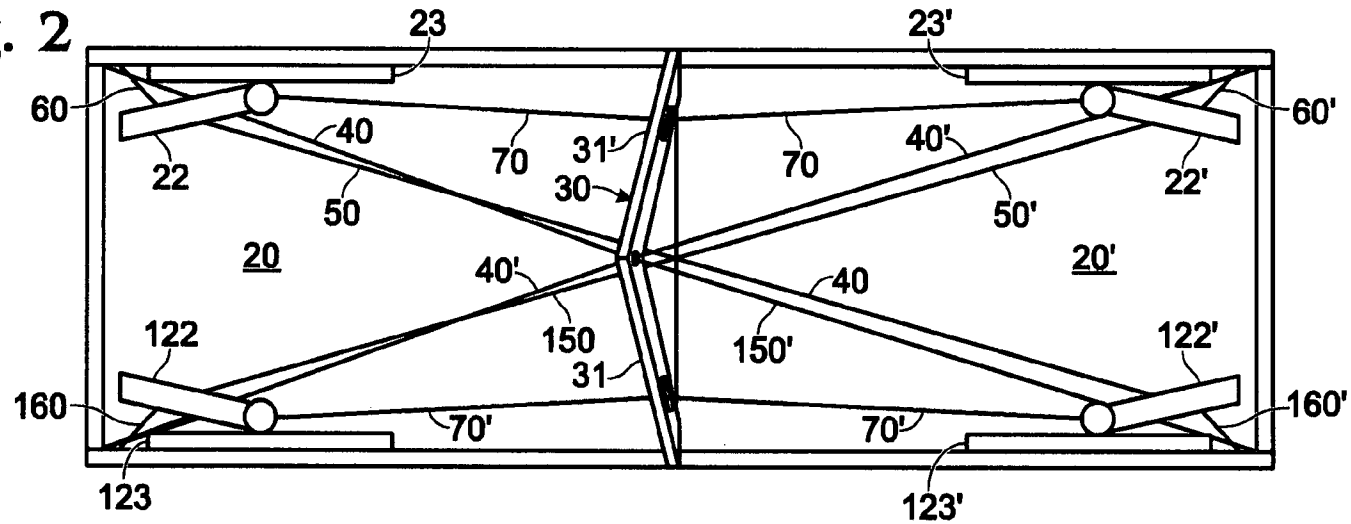
FIG. 2 is a bottom plan view of the massage table of the present invention.
Figure 3:
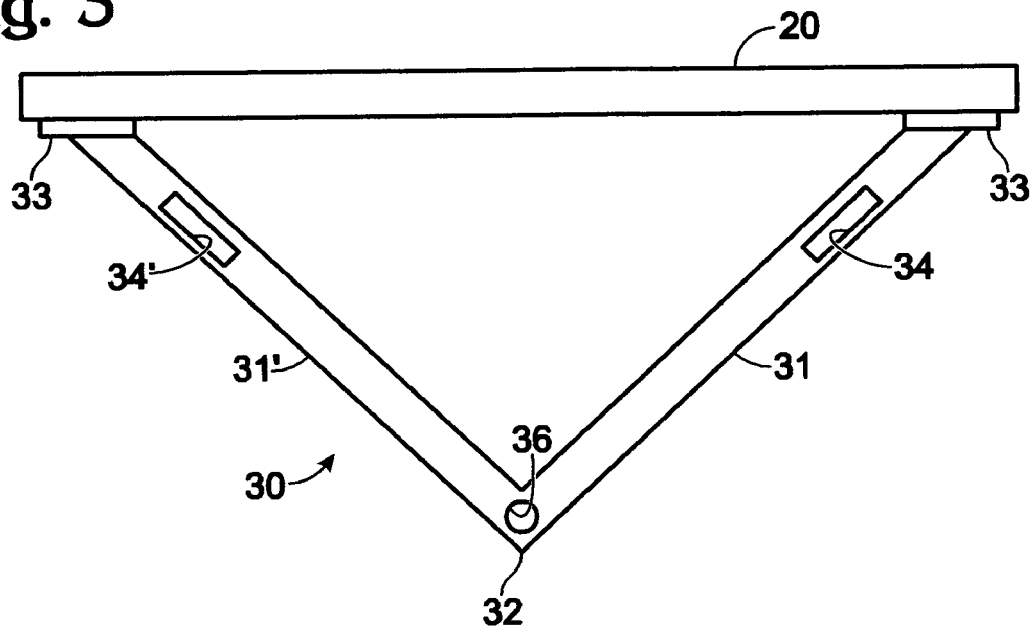
FIG. 3 is a front elevation view of the rigid, V-shaped truss member of the massage table of the present invention.

Massage table 10 of the present invention includes a pair of table top sections 20 and 20' abutting and hingedly connected at their adjacent inner ends. Table top sections 20 and 20' are illustrated in FIGS. 1 and 2 in their operative, fully deployed position with the top surfaces thereof being co-planar.

There are four substantially identical table legs 22, 122, 22' and 122' which are pivotally connected to leg blocks 23, 123, 23' and 123', respectively, the leg blocks being attached to the perimeter frame rails of table sections 20 and 20' adjacent each of the four outer corners thereof. Legs 22, 122, 22' and 122' can each be telescoping.

First table leg 22 is located adjacent a first outer corner of table top section 20 and second table leg 122 is located adjacent the second outer corner of table top section 20. Third table leg 22' is located adjacent a first outer corner of table top section 20' and fourth table leg 122' is located adjacent the second outer corner of table top section 20'. Table legs 22, 122, 22' and 122' are shown in their fully deployed position in FIGS. 1 and 2.

A rigid, V-shaped truss member 30 includes first and second truss legs 31 and 31', each truss leg having an inner and an outer end. The outer ends of first and second truss legs 31 and 31' are connected together to form an apex 32.

Truss member 30 is shown as extending downwardly from table top section 20, truss legs 31 and 31' being attached thereto by suitable hinge members 33. However, truss member 30 could extend downwardly from table top section 20'. Truss member 30 includes first and second slots 34 and 34' located in each of first and second legs 31 and 31', respectively. An opening 36 passes through apex 32.

A first table support cable 40 extends from the first outer corner of table top section 20 to the diagonally opposite second outer corner of table top section 20'. A second table support cable 40' extends from the second outer corner of table top section 20 to the diagonally opposite first outer corner of table top section 20'. Both table support cables 40 and 40' pass through opening 36 in truss member 30.

First table leg 22 is attached to the outer end of a first table leg support cable 50 at an attachment point located in the lower half of table leg 22. The inner end of first table leg support cable 50 is attached to the inner end of table top section 20 at an attachment point located in a mid-portion thereof. First table leg 22 is connected to the outer end of a second table leg support cable 60 at an attachment point located in the mid-portion of table leg 22. The inner end of second table leg support cable 60 is attached to table top section 20 at a location adjacent its first outer corner.

Second table leg 122 is attached to the outer end of a first table leg support cable 150 at an attachment point located in the lower half of table leg 122. The inner end of first table leg support cable 150 is attached to the inner end of table top section 20 at an attachment point located in a mid-portion thereof. Second table leg 122 is attached to the outer end of a second table leg support cable 160 at an attachment point located in the mid-portion of table leg 122. The inner end of second table leg support cable 160 is attached to table top section 20 at a location adjacent its second outer corner.

Third table leg 22' is attached to the outer end of a first table leg support cable 50' at an attachment point located in the lower half of third table leg 22'. The inner end of first table leg support cable 50' is attached to the inner end of table top section 20' at an attachment point located in a mid-portion thereof. Third table leg 22' is attached to the outer end of a second table leg support cable 60' at an attachment point located in the mid-portion of third table leg 22'. The inner end of second table leg support cable 60' is attached to table top section 20' at a location adjacent its first outer corner.

Fourth table leg 122' is attached to the outer end of a first table leg support cable 150' at an attachment point located in the lower half of fourth table leg 122'. The inner end of first table leg support cable 150' is attached to the inner end of table top section 20' at an attachment point located in the mid-portion thereof. Fourth table leg 122' is attached to the outer end of a second table leg support cable 160' at an attachment point located in the mid-portion of fourth table leg 122'. The inner end of second table leg support cable 160' is attached to table top section 20' at a location adjacent its second outer corner.

A third table leg support cable 70 extends between attachment points located at the tops of first and third table legs 22 and 22', respectively, through first slot 34 located in the first leg 31 of the truss member 30. Similarly, a third table leg support cable 70' also extends between attachment points located at the tops of the second and fourth table legs 122 and 122', respectively, through a second slot 34' in the second leg 31'of the truss member 30.

Figure 4:
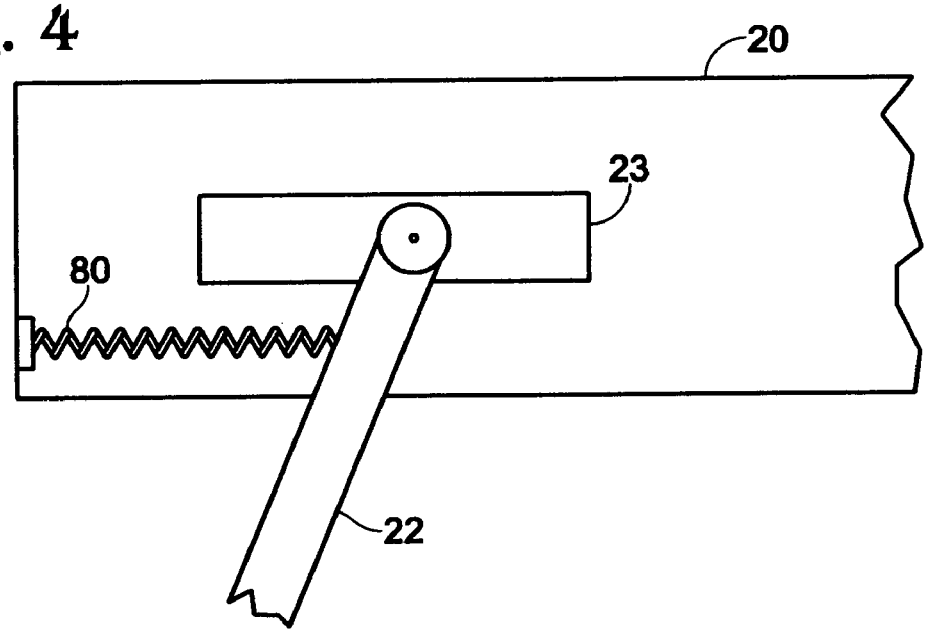
FIG. 4 is a partial side elevation view of a leg member and associated spring member.

To assist in maintaining the leg members in their deployed position, spring members 80 can be attached thereto adjacent the tops thereof, as shown in FIG. 4 relative to table leg 22. Spring members 80 can be elastic cord members, such as bungee cord.

After usage, portable massage table 10 can be collapsed into a compact travel case formed by table top sections 20 and 20' by folding the table legs 22, 122, 22' and 122' upwardly towards and against the lower surface of the table top sections, and folding the table top sections towards and against each other. A suitable latch member can be used to hold table top sections 20 and 20' together.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A portable massage table comprising:

a rectangular table top including a pair of table top sections having inner and outer ends and first and second sides, said pair of table top sections abutting each other at their inner ends and hingedly connected to one another at said inner ends, each of said table top sections having first and second inner corners at the juncture of said inner end with said first and second sides, respectively, each of said table top sections having first and second outer corners at the juncture of said outer end with said first and second sides, respectively;

a centrally positioned V-shaped truss member having first and second truss leg members having inner and outer ends, said first and second truss leg members being joined at their outer ends to form a truss apex, said inner ends of said first and second truss leg members being hingedly secured to the inner end of one of said first and second table top sections, said truss member having an opening passing through said apex, said truss member having first and second slots passing through each of said first and second truss leg members, respectively, adjacent the inner ends thereof;

first and second table legs located adjacent said first and second outer corners of said first table top section, respectively, said first and second table legs being pivotally connected to said first table top section;

third and fourth table legs located adjacent said first and second outer corners of said second table top section, respectively, said first and second table legs being pivotally connected to said second table top section;

a first table support cable extending from said first corner of said first table top section through said opening at said apex of said truss member and to said second corner of said second table top section;

a second table support cable extending from said second corner of said first table top section through said opening at said apex of said truss member and to said first corner of said second table top section;

first table leg support cables extending from and attached to a mid-portion of said inner end of said first table top section to each of said first and second table legs and attached thereto in the lower half thereof, and extending from and attached to a mid-portion of said inner end of said second table top section to each of said third and fourth table legs and attached thereto in the lower half thereof;

second table leg support cables extending from a location adjacent said first and second corners of said first table top section to an attachment point located in a mid-portion of each of said first and second table legs, respectively, and extending from a location adjacent said first and second corners of said second table top section to an attachment point located in a mid-portion of each of said third and fourth table legs, respectively; and third table leg support cables attached to the tops of said first and third table legs and extending through said first slot in said first leg of said truss member, and attached to the tops of said second and fourth table legs and extending through said second slot in said second leg of said truss member.

2. The table of claim 1 including spring members attached at one end to the upper portion of each table leg and at their other ends to the adjacent outer end of their respective table tops.

* * * * *